US011133634B2

(12) United States Patent
Takeda et al.

(10) Patent No.: US 11,133,634 B2
(45) Date of Patent: Sep. 28, 2021

(54) TERMINAL-EQUIPPED ELECTRIC WIRE MANUFACTURING APPARATUS AND TERMINAL-EQUIPPED ELECTRIC WIRE

(71) Applicant: Yazaki Corporation, Tokyo (JP)

(72) Inventors: Hirotaka Takeda, Makinohara (JP); Kei Sato, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 16/817,052

(22) Filed: Mar. 12, 2020

(65) Prior Publication Data

US 2020/0335926 A1 Oct. 22, 2020

(30) Foreign Application Priority Data

Apr. 16, 2019 (JP) ..... JP2019-077669

(51) Int. Cl.

| | |
|---|---|
| ***H01R 43/00*** | (2006.01) |
| ***H01R 4/18*** | (2006.01) |
| ***H01R 43/048*** | (2006.01) |
| ***H01R 4/70*** | (2006.01) |

(52) U.S. Cl.

CPC ..... *H01R 43/005* (2013.01); *H01R 4/185* (2013.01); *H01R 4/70* (2013.01); *H01R 43/048* (2013.01)

(58) Field of Classification Search

CPC .... H01R 43/18; H01R 43/005; H01R 43/048; H01R 4/185; H01R 4/70; H01R 4/2445; H01R 24/20; B29C 45/14418; B29C 45/14467; B29C 45/14426

USPC ..... 439/604, 519, 606, 865

See application file for complete search history.

(56) References Cited

U.S. PATENT DOCUMENTS

| | | | | |
|---|---|---|---|---|
| 6,514,064 | B2 * | 2/2003 | Kondo | H01R 4/70 425/116 |
| 6,517,381 | B2 * | 2/2003 | Kondo | H01R 4/70 439/604 |
| 6,761,551 | B2 * | 7/2004 | Kondo | B29C 45/14426 425/116 |
| 7,669,324 | B2 * | 3/2010 | Daito | H01B 7/285 29/861 |
| 8,304,649 | B2 * | 11/2012 | Arai | H01B 7/285 174/23 R |

(Continued)

FOREIGN PATENT DOCUMENTS

| | | | |
|---|---|---|---|
| JP | 2017-199602 | A | 11/2017 |
| JP | 2017-204455 | A | 11/2017 |
| JP | 2018-106864 | A | 7/2018 |

*Primary Examiner* — Peter G Leigh

(74) *Attorney, Agent, or Firm* — Banner & Witcoff, Ltd.

(57) ABSTRACT

A terminal-equipped electric wire manufacturing apparatus, includes: a placing table on which a crimp terminal is placed while kept crimped to an electric wire; and a supply device that supplies an anticorrosive material to the crimp terminal placed on the placing table while kept crimped to the electric wire. While kept crimped to the electric wire, the crimp terminal has a communication hole allowing communication between a gap space portion in the crimp terminal and outside of the crimp terminal gap space portion. The placing table has a distribution hole positioned opposite the communication hole of the placed crimp terminal, the distribution hole allowing the anticorrosive material, supplied from the supply device, to flow in the distribution hole.

9 Claims, 9 Drawing Sheets

(56) References Cited

U.S. PATENT DOCUMENTS 8,360,803 B2 * 1/2013 Sakai ..... H01R 43/005 439/523
8,723,040 B2 * 5/2014 Sakura ..... H01R 4/70 174/74 R
8,771,015 B2 * 7/2014 Inoue ..... H01R 4/70 439/604
8,927,863 B2 * 1/2015 Tanikawa ..... H02G 15/04 174/74 R
9,065,261 B2 * 6/2015 Kawamura ..... H01R 4/183
9,083,100 B2 * 7/2015 Uno ..... H01R 43/24
9,293,838 B2 * 3/2016 Sakaguchi ..... H01R 4/62
9,325,085 B2 * 4/2016 Tanaka ..... H01R 43/005
9,368,929 B2 * 6/2016 Matsushita ..... H01R 11/12
9,564,690 B2 * 2/2017 Kondo ..... H01R 4/70
9,640,879 B2 * 5/2017 Tanaka ..... H01R 4/70
9,673,586 B2 * 6/2017 Sato ..... B29C 45/14639
9,721,700 B2 * 8/2017 Kuriyagawa ..... H02G 15/04
9,748,724 B2 * 8/2017 Sato ..... H01R 43/24
9,755,327 B2 * 9/2017 Aoki ..... H01R 13/5216
9,774,099 B2 * 9/2017 Aoki ..... H01R 4/70
9,954,289 B2 * 4/2018 Miyakawa ..... H01R 4/70
2002/0127915 A1 9/2002 Kondo
2008/0185169 A1 * 8/2008 Daito ..... H01B 7/285 174/23 R
2008/0283268 A1 * 11/2008 Iwasaki ..... H01B 7/285 174/78
2013/0126234 A1 * 5/2013 Ono ..... H02G 15/08 174/75 R
2014/0059853 A1 * 3/2014 Steinberg ..... H01R 43/005 29/855
2014/0144016 A1 * 5/2014 Bauer ..... B23K 26/21 29/863
2014/0318862 A1 * 10/2014 Tachi ..... B29C 45/14467 174/75 R
2016/0372881 A1 * 12/2016 Bauer ..... B23K 26/21
2018/0076532 A1 * 3/2018 Iwasawa ..... H01R 4/70
2019/0027883 A1 * 1/2019 Saito ..... H01R 43/048

* cited by examiner

TERMINAL-EQUIPPED ELECTRIC WIRE MANUFACTURING APPARATUS AND TERMINAL-EQUIPPED ELECTRIC WIRE

CROSS-REFERENCE TO RELATED APPLICATION(S)

The present application claims priority to and incorporates by reference the entire contents of Japanese Patent Application No. 2019-077669 filed in Japan on Apr. 16, 2019.

BACKGROUND OF THE INVENTION

1. Field of the Invention

The present invention relates to a terminal-equipped electric wire manufacturing apparatus and a terminal-equipped electric wire.

2. Description of the Related Art

As a conventional method for manufacturing a terminal-equipped electric wire, for example, Japanese Patent Application Laid-open No. 2018-106864 discloses a manufacturing method for a terminal-equipped electric wire in which a core-wire crimp piece projecting from part of a bottom portion of a terminal is crimped to an end, exposed from an insulation cover, of the core wire of an electric wire and an exposed part of the core wire has been subjected to anticorrosive treatment.

By the way, in the manufacturing method for the terminal-equipped electric wire described in the foregoing Japanese Patent Application Laid-open No. 2018-106864, the need for, for example, further improvement in ensuring more reliable water-impervious performance still exists.

SUMMARY OF THE INVENTION

The present invention has been made in view of the foregoing situation. Accordingly, it is an object of the present invention to provide a terminal-equipped electric wire manufacturing apparatus that can manufacture a terminal-equipped electric wire that ensures appropriate water-impervious performance, and to provide the terminal-equipped electric wire.

In order to achieve the above mentioned object, a terminal-equipped electric wire manufacturing apparatus according to one aspect of the present invention includes a placing table on which a crimp terminal is placed while kept crimped to an electric wire, the crimp terminal including a covering crimp portion crimped to an insulative covering portion of the electric wire in which a conductor portion having conductivity is covered with the insulative covering portion having insulating properties, and a conductor crimp portion crimped to the conductor portion exposed from an end of the insulative covering portion; and a supply device that supplies an anticorrosive material to the crimp terminal placed on the placing table while kept crimped to the electric wire, wherein while kept crimped to the electric wire, the crimp terminal has a communication hole allowing communication between a gap space portion and outside of the crimp terminal, the gap space portion being surrounded by the crimp terminal, the conductor portion, and the end of the insulative covering portion, and the placing table has a distribution hole positioned opposite the communication hole of the crimp terminal placed while kept crimped to the electric wire, the distribution hole allowing the anticorrosive material, supplied from the supply device, to flow in the distribution hole.

According to another aspect of the present invention, in the terminal-equipped electric wire manufacturing apparatus, it is possible to configure that the supply device includes a filling device that fills the anticorrosive material into the gap space portion via the distribution hole and the communication hole while the crimp terminal crimped to the electric wire is kept placed on the placing table.

According to still another aspect of the present invention, in the terminal-equipped electric wire manufacturing apparatus, it is possible to configure that the filling device is able to fill the anticorrosive material until the anticorrosive material supplied via the distribution hole and the communication hole extrude from between the conductor crimp portion and the covering crimp portion via the conductor portion.

According to still another aspect of the present invention, in the terminal-equipped electric wire manufacturing apparatus, it is possible to configure that the supply device includes an application device that, while the crimp terminal crimped to the electric wire is placed on the placing table, applies the anticorrosive material to the conductor portion exposed between the covering crimp portion and the conductor crimp portion, and a suction device that sucks, via the gap space portion, the communication hole, and the distribution hole, the anticorrosive material applied to the conductor portion by the application device.

According to still another aspect of the present invention, in the terminal-equipped electric wire manufacturing apparatus, it is possible to configure that the placing table is composed of an anvil that crimps the crimp terminal to the electric wire.

In order to achieve the above mentioned object, a terminal-equipped electric wire according to still another aspect of the present invention includes an electric wire in which a conductor portion having conductivity is covered with an insulative covering portion having insulating properties; a crimp terminal including a covering crimp portion crimped to the insulative covering portion, and a conductor crimp portion crimped to the conductor portion exposed from an end of the insulative covering portion; and an anticorrosive material applied to the crimp terminal, wherein while kept crimped to the electric wire, the crimp terminal has a communication hole allowing communication between a gap space portion and outside of the crimp terminal, the gap space portion being surrounded by the crimp terminal, the conductor portion, and the end of the insulative covering portion, and the gap space portion and the communication hole are filled with the anticorrosive material.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Embodiments according to the present invention will be described below in detail with reference to the drawings. The present invention is not limited by these embodiments. In addition, the compositional elements in the embodiments described below include ones that can easily be replaced by those skilled in the art or ones that are substantially the same.

First Embodiment

Figure 1:
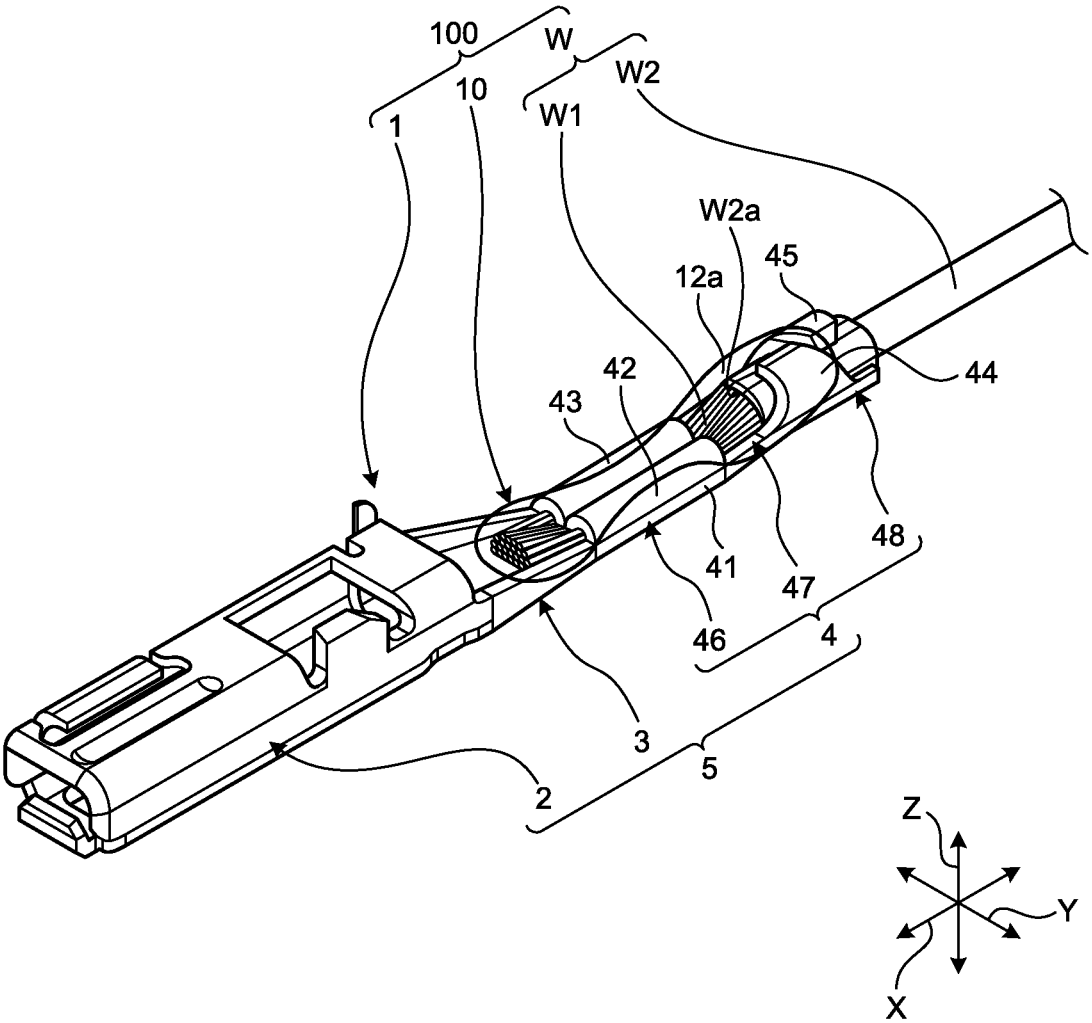
FIG. 1 is a perspective view illustrating a schematic configuration of a terminal-equipped electric wire according to a first embodiment.
Figure 2:
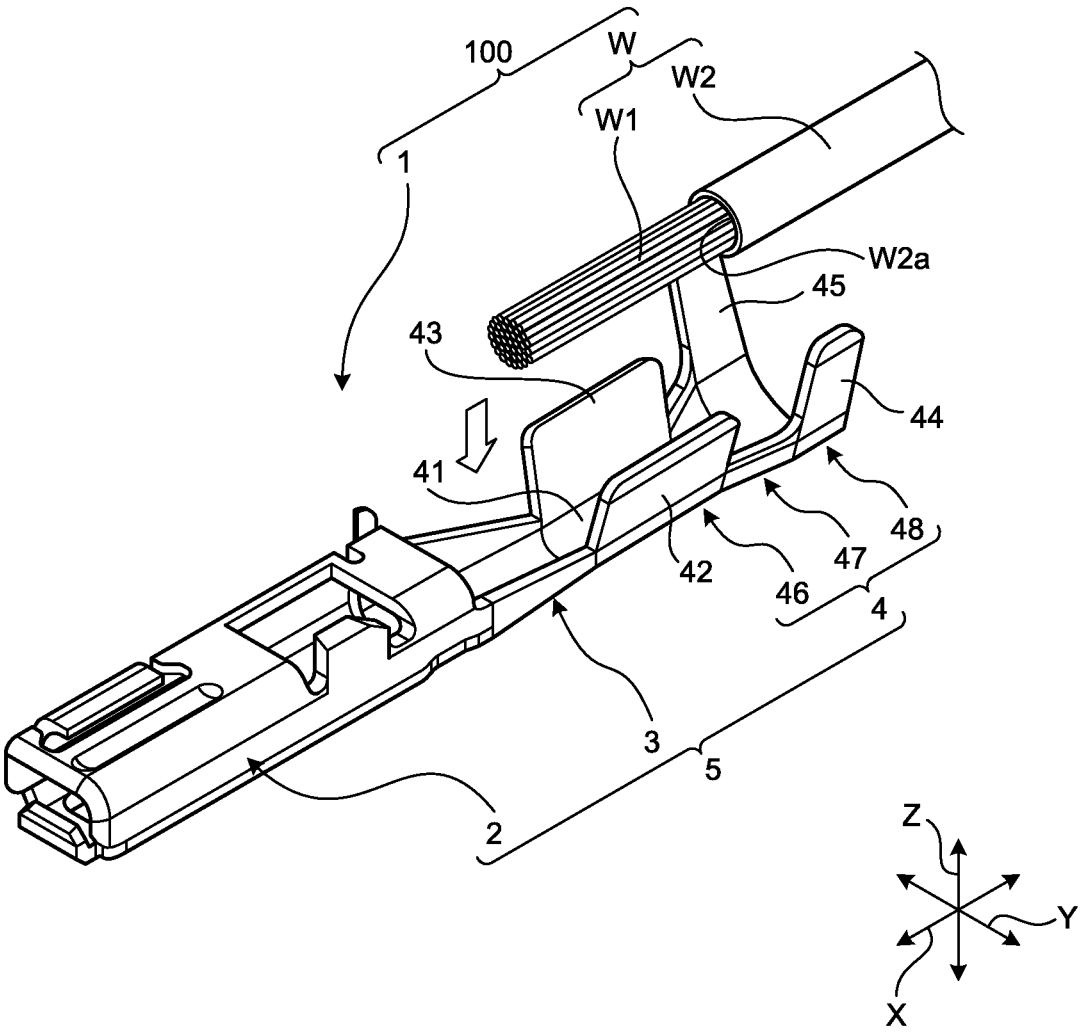
FIG. 2 is an exploded perspective view illustrating a state of the terminal-equipped electric wire according to the first embodiment before crimping of a crimp terminal.
Figure 3:
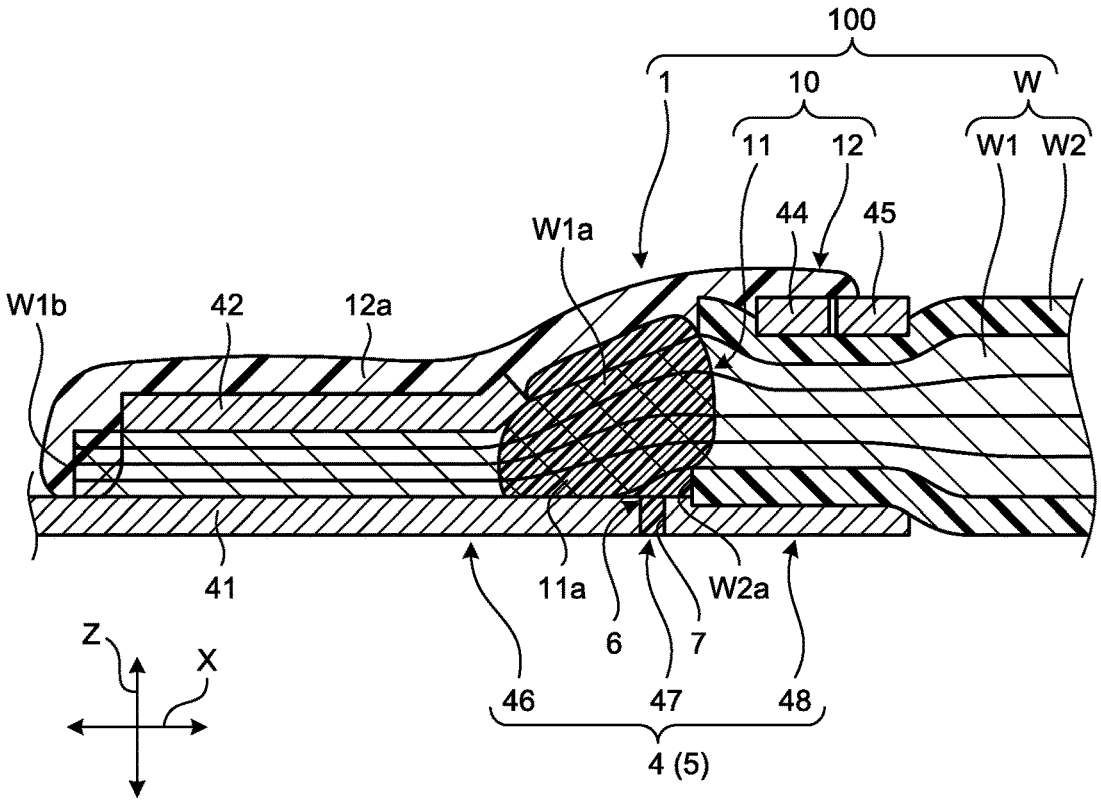
FIG. 3 is a schematic cross-sectional view illustrating a schematic configuration of a terminal-equipped electric wire according to the first embodiment.
Figure 4:
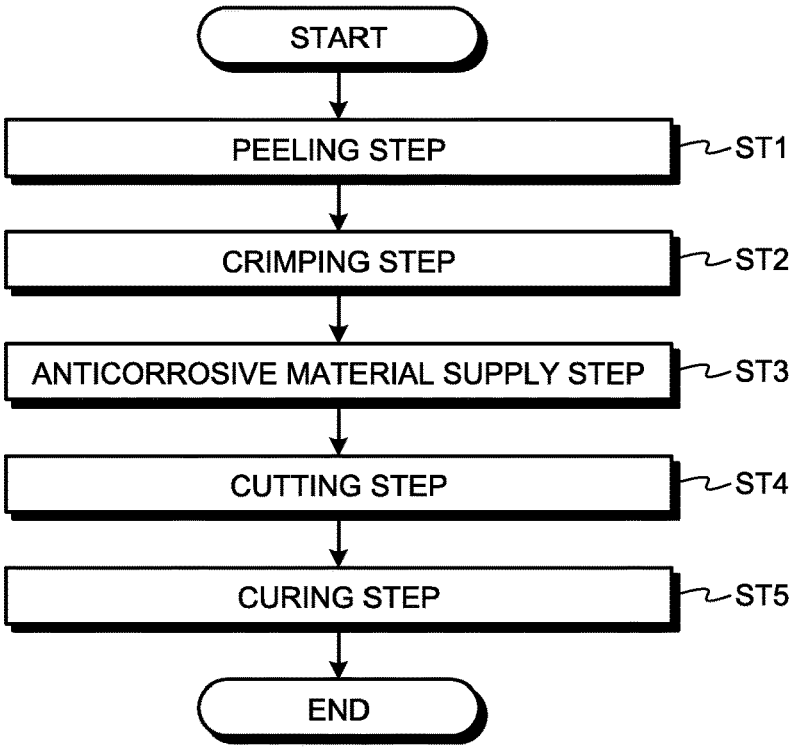
FIG. 4 is a flowchart illustrating a terminal-equipped electric wire manufacturing method executed by the terminal-equipped electric wire manufacturing apparatus according to the first embodiment.

A manufacturing apparatus M (see FIG. 5) as a terminal-equipped electric wire manufacturing apparatus according to the present embodiment manufactures a terminal-equipped electric wire 100 illustrated in FIGS. 1, 2, and 3. In the following description, the basic configuration of the terminal-equipped electric wire 100 illustrated in FIGS. 1, 2 and 3 will be described first, and then the manufacturing apparatus M and the terminal-equipped electric wire manufacturing method will be described in detail.

The terminal-equipped electric wire 100 illustrated in FIGS. 1, 2, and 3 is applied to, for example, a wire harness used in a vehicle or the like. Here, the wire harness is formed as a collective component by bundling a plurality of electric wires W used for power supply and signal communication in order to, for example, connect devices mounted on a vehicle, and the plurality of electric wires W are connected to each device with a connector or the like. The terminal-equipped electric wire 100 of the present embodiment includes: an electric wire W; a crimp terminal 1 crimped to an end of this electric wire W; and an anticorrosive water-impervious portion 10 formed from an anticorrosive material (a first anticorrosive material 11*a* and a second anticorrosive material 12*a* described below (see FIG. 3, etc.)) and rendering each part impervious to water.

In the following description, among a first direction, a second direction, and a third direction intersecting one another, the first direction is referred to as "axial direction X", the second direction is referred to as "width direction Y", and the third direction is referred to as "height direction Z". Here, the axial direction X, the width direction Y, and the height direction Z are substantially orthogonal to one another. The axial direction X typically corresponds to the extending direction of the electric wire W on which the crimp terminal 1 is provided, and corresponds to the direction in which an electrical connection portion 2 of the crimp terminal 1 and an electric-wire crimp portion 4 of the crimp terminal 1 are arranged. The width direction Y and the height direction Z correspond to intersecting directions, i.e., directions intersecting the axial direction X. In addition, each direction used in the following description indicates a direction in a state in which respective parts are mutually fitted together, unless otherwise specified.

The electric wire W includes, for example: a linear conductor portion W1 having conductivity; and an insulative covering portion W2 covering the outside of the conductor portion W1 and having an insulating property. The electric wire W is an insulated electric wire in which the conductor portion W1 is covered with the insulative covering portion W2. The conductor portion W1 of the present embodiment is a core wire formed by bundling together a plurality of strands of conductive metal, for example, copper, copper alloy, aluminum, aluminum alloy, etc., but it may be a twisted core wire formed by twisting a plurality of strands together. The insulative covering portion W2 is an electric wire covering that covers the outer peripheral side of the conductor portion W1. The insulative covering portion W2 is formed by extrusion molding, for example, an insulating resin material (PP, PVC, cross-linked PE or the like. Appropriately selected taking wear resistance, chemical resistance, heat resistance, etc., into consideration). In the electric wire W, the insulative covering portion W2 is peeled off at least at one end of the conductor portion W1, one end of the conductor portion W1 is exposed from the end W2*a* of the insulative covering portion W2, and the crimp terminal 1 is crimped to the end of the exposed conductor portion W1. Here, the electric wire W is formed so as to extend having substantially the same diameter with respect to the extending direction, which extends linearly, the cross-sectional shape of the conductor portion W1 (the cross-sectional shape in the direction intersecting the extending direction) is substantially circular, the cross-sectional shape of the insulative covering portion W2 is substantially annular and, therefore, the cross-sectional shape is substantially circular as a whole.

The crimp terminal 1 includes the electrical connection portion 2, a coupling portion 3, and an electric-wire crimp portion 4. The electrical connection portion 2, the coupling portion 3, and the electric-wire crimp portion 4 compose a terminal fitting 5 by their being integrally made of a conductive metal such as copper, copper alloy, aluminum, aluminum alloy, etc. For example, the crimp terminal 1 is formed, for example, by press and bend molding a single sheet of metal punched into a shape having portions corresponding to the electrical connection portion 2, the coupling portion 3, the electric-wire crimp portion 4, etc., thereby three-dimensionally integrating these portions. In the crimp terminal 1, the electrical connection portion 2, the coupling portion 3, and the electric-wire crimp portion 4 are mutually coupled by their being arranged in that order from one side to the other along the axial direction X.

The electrical connection portion 2 is a portion that is electrically connected to a conductive member. The conductive member in the present embodiment is, for example, a mating terminal (not illustrated). That is, here, the electrical connection portion 2 of the present embodiment is configured as a terminal connection portion that is electrically connected to the mating terminal. The electrical connection portion 2 may have a male terminal shape or a female terminal shape. The electrical connection portion 2 of the present embodiment is illustrated in a female terminal shape, and is electrically connected to a mating terminal-equipped a male terminal shape. Note that the conductive member may not be a mating terminal, but may be a variety of conductive members such as a ground member, for example. The electrical connection portion 2 does not need to constitute a terminal connection portion that is electrically connected to a mating terminal but may have, for example, a so-called round terminal (LA terminal) shape that is fastened to a ground member or the like.

The coupling portion 3 is a portion that is interposed between the electrical connection portion 2 and the electric-wire crimp portion 4 and couples this electrical connection portion 2 and this electric-wire crimp portion 4. In the crimp terminal 1, the electrical connection portion 2 and the electric-wire crimp portion 4 are electrically connected via the coupling portion 3, and the electrical connection portion 2 and the conductor portion W1 of the electric wire W are electrically connected and conducted via the electric-wire crimp portion 4.

The electric-wire crimp portion 4 is a portion that electrically connects the crimp terminal 1 and the end of the electric wire W. The electric-wire crimp portion 4 is caulked and crimped to the end of the electric wire W. The electric-wire crimp portion 4 includes a base 41 and two pairs of barrel pieces 42, 43, and 44, 45. The electric-wire crimp portion 4 is caulked and crimped to the electric wire W by the base 41 and two pairs of barrel pieces 42, 43, and 44, 45. In the electric-wire crimp portion 4, a conductor crimp portion 46, an intermediate portion 47, and a covering crimp portion 48 are composed of the base 41 and two pairs of barrel pieces 42, 43, and 44, 45. In other words, the electric-wire crimp portion 4 includes the conductor crimp portion 46, intermediate portion 47, and covering crimp portion 48, which are composed of the base 41 and the two pairs of barrel pieces 42, 43, and 44, 45. The conductor crimp portion 46 is composed of part of the base 41 and the pair of barrel pieces 42, 43. The intermediate portion 47 is composed of part of the base 41. The covering crimp portion 48 is composed of part of the base 41 and the pair of barrel pieces 44, 45. In the electric-wire crimp portion 4, the conductor crimp portion 46, the intermediate portion 47, and the covering crimp portion 48 are mutually coupled by their being arranged in that order from the electrical connection portion 2 side to the opposite side along the axial direction X. The electric-wire crimp portion 4 composes a so-called separate barrel-type crimp portion in which the pair of barrel pieces 42, 43 and the pair of barrel pieces 44, 45 are separated via the intermediate portion 47.

The base 41 is a portion that extends along the axial direction X and serves as a bottom wall of the electric-wire crimp portion 4 formed in a U shape. On the base 41, an end of the electric wire W is placed during a crimping process. The electrical connection portion 2 is coupled to one side, in the axial direction X, of the base 41 via the coupling portion 3. In the base 41, both edges, in the width direction Y, of each of portions including the intermediate portion 47 extend upward in the height direction Z (see FIG. 7, etc.). The base 41 is coupled to a carrier on the other side in the axial direction X before a crimping process and is disconnected from the carrier at the time of the crimping process, for example.

The pair of barrel pieces 42, 43 are portions composing the conductor crimp portion 46 together with part of the base 41. The conductor crimp portion 46 is a portion that is provided on the one-end side, in the axial direction X, of the electric-wire crimp portion 4, here, on the electrical connection portion 2 side, and is caulked and crimped to the conductor portion W1 of the electric wire W. In other words, the conductor crimp portion 46 is a portion that is electrically connected to the conductor portion W1 by its being caulked and crimped to the conductor portion W1. The pair of barrel pieces 42, 43 are portions extending in belt forms on both sides in the width direction Y from the base 41 in this conductor crimp portion 46 and caulked and crimped such that the conductor portion W1 of the electric wire W is wrapped between the base 41 and these barrel pieces. The barrel pieces 42, 43 are portions serving as side walls of the electric-wire crimp portion 4 formed in the U shape before the crimping process. The barrel piece 42 extends from the base 41 to one side in the width direction Y intersecting the axial direction X. The barrel piece 43 extends from the base 41 to the other side in the width direction Y. Before caulked and crimped to the conductor portion W1 of the electric wire W (see FIG. 2), the barrel pieces 42, 43 are formed in an approximately U shape together with the base 41 by their being bent with respect to the base 41. In the pair of barrel pieces 42, 43 of the present embodiment, their respective lengths from the root on the base 41 side to their respective leading edges are set such that these barrel pieces do not extend beyond (overlap) each other in the states of being caulked and crimped around the electric wire W. The pair of barrel pieces 42, 43 may have the same length from the root on the base 41 side to their respective leading edges, and one length may be greater than the other. Here, the pair of barrel pieces 42, 43 are illustrated as being subjected to caulking and crimping referred to as a so called B-crimp, but the present invention is not limited thereto. In the B-crimp, barrel pieces 42, 43 are caulked and crimped such that each of the barrel pieces 42, 43 is bent toward the base 41 and the respective leading edges are pressed against the electric wire W. The conductor crimp portion 46 is caulked and crimped to the conductor portion W1 such that the base 41 and the pair of barrel pieces 42, 43 wrap the outside of the conductor portion W1 of the electric wire W located between the pair of barrel pieces 42, 43. In the conductor crimp portion 46, portions where the base 41 and the pair of barrel pieces 42, 43 are in contact with the conductor portion W1 may be provided with serrations or the like to increase the contact area with the conductor portion W1 and to improve contact stability as well as adhesion strength. In addition, the conductor crimp portion 46 is not limited to the above type, and may be configured such that, for example, a pair of barrel pieces 42, 43 extend beyond (overlap) each other in the states of being caulked and crimped around the electric wire W.

The pair of barrel pieces 44, 45 are portions composing the covering crimp portion 48 together with part of the base 41. The covering crimp portion 48 is a portion that is provided on the other end side, in the axial direction X, of the electric-wire crimp portion 4, here, on the opposite side to the electrical connection portion 2 side, and is caulked and crimped to the insulative covering portion W2 of the electric wire W. Here, in the electric-wire crimp portion 4, the intermediate portion 47 is interposed between the covering crimp portion 48 and the conductor crimp portion 46 with respect to the axial direction X. The intermediate portion 47 is a portion that is interposed between the conductor crimp portion 46 and the covering crimp portion 48 and that couples the conductor crimp portion 46 and the covering crimp portion 48. The pair of barrel pieces 44, 45 are portions extending in belt forms on both sides in the width direction Y from the base 41 in this covering crimp portion 48 and caulked and crimped such that the insulative covering portion W2 of the electric wire W is wrapped between the base 41 and these barrel pieces. The barrel pieces 44, 45 are portions serving as side walls of the electric-wire crimp portion 4 formed in the U shape before the crimping process. The barrel piece 44 extends from the base 41 to one side in the width direction Y intersecting the axial direction X. The barrel piece 45 extends from the base 41 to the other side in the width direction Y. Before caulked and crimped to the insulative covering portion W2 of the electric wire W (see FIG. 2), the barrel pieces 44, 45 are formed in an approximately U shape together with the base 41 by their being bent with respect to the base 41. The barrel pieces 44, 45 are formed separate from the barrel pieces 42, 43, respectively, with the intermediate portion 47 interposed between the barrel pieces 42, 43 and these barrel pieces. In the pair of barrel pieces 44, 45 of the present embodiment, their respective lengths from the root on the base 41 side to their respective leading edges are set such that these barrel pieces do not extend beyond (overlap) each other in the states of being caulked and crimped around the electric wire W. In addition, these barrel pieces are formed in different positions in the axial direction X. The pair of barrel pieces 44, 45 may have the same length from the root on the base 41 side to their respective leading edges, and one length may be greater than the other. The covering crimp portion 48 is caulked and crimped to the insulative covering portion W2 such that the base 41 and the pair of barrel pieces 44, 45 wrap the outside of the insulative covering portion W2 of the electric wire W located between the pair of barrel pieces 44, 45. In addition, the covering crimp portion 48 may be configured such that, for example, a pair of barrel pieces 44, 45 extend beyond (overlap) each other in the states of being caulked and crimped around the electric wire W.

As illustrated in FIG. 3, the anticorrosive water-impervious portion 10 is formed by curing the anticorrosive material (the first anticorrosive material 11*a* and the second anticorrosive material 12*a*) applied to the crimp terminal 1 and makes each part of the terminal-equipped electric wire 100 impervious to water. Here, the anticorrosive water-impervious portion 10 includes a first anticorrosive water-impervious portion 11 and a second anticorrosive water-impervious portion 12. The first anticorrosive water-impervious portion 11 is a portion making a predetermined portion inside the crimp terminal 1 impervious to water by applying and curing the first anticorrosive material 11*a*, or the first anticorrosive material, to the predetermined portion inside the crimp terminal 1. The second anticorrosive water-impervious portion 12 is a portion making a predetermined portion outside the crimp terminal 1 impervious to water by applying and curing the second anticorrosive material 12*a*, or the second anticorrosive material, to the predetermined portion outside the crimp terminal 1. The first anticorrosive material 11*a* and the second anticorrosive material 12*a* in the present embodiment are both resins that cure as a result of changing respective cure degree when the resins are exposed to light and, for example, a UV (Ultraviolet) curable resin that cures by emission of ultraviolet rays thereto can be used. That is, here, the anticorrosive water-impervious portion 10 is formed by curing the first anticorrosive material 11*a* and the second anticorrosive material 12*a* that are photo-curable resins. The UV curable resin may be, for example, a urethane acrylate resin but it is not limited thereto. As the first anticorrosive material 11*a* and the second anticorrosive material 12*a*, the same UV curable resin can typically be used but, for example, different ones may be used depending on the situation where each is applied. They are made different from each other in, for example, viscosity or the like.

The crimp terminal 1 of the present embodiment has a communication hole 7 that allows communication between the gap space portion 6 formed inside the crimp terminal 1 and the outside of the crimp terminal 1 and the first anticorrosive material 11*a* can be supplied into the crimp terminal 1 via the communication hole 7. With this configuration, the crimp terminal 1 is configured to reliably supply the first anticorrosive material 11*a* to the gap space portion 6 where it is difficult to supply the first anticorrosive material 11*a* from outside.

Here, the gap space portion 6 is a space portion surrounded by the crimp terminal 1, the conductor portion W1, and the end W2*a* of the insulative covering portion W2 inside the crimp terminal 1 while the crimp terminal 1 is kept crimped to the electric wire W. In the electric wire W, while the crimp terminal 1 is kept crimped, the end W2*a* of the insulative covering portion W2 is located between the conductor crimp portion 46 and the covering crimp portion 48, that is, in the intermediate portion 47. The gap space portion 6 is a gap defined between the internal surface of the base 41 of the crimp terminal 1 and the external surface of the conductor portion W1 due to a step corresponding to the thickness of the end W2*a* of the insulative covering portion W2 inside the crimp terminal 1. The gap space portion 6 is defined as a substantially arcuate gap along a step caused according to the thickness of the end W2*a* of the insulative covering portion W2.

The communication hole 7 is formed so as to allow communication between the gap space portion 6 formed as described above and the outside of the crimp terminal 1. The communication hole 7 is provided in a portion of the crimp terminal 1, where the gap space portion 6 is formed, and allows communication between the inside and outside of the crimp terminal 1. Here, the communication hole 7 is formed in a portion of the base 41 which portion composes the intermediate portion 47 and also defines the gap space portion 6. The communication hole 7 is formed through the base 41 in the height direction Z or the like. The communication hole 7 is formed typically in a substantially cylindrical shape, but is not limited thereto, and may be formed in a substantially elliptical column shape, a substantially long cylindrical shape, or a substantially rectangular slit shape. In addition, at least one communication hole 7 will suffice, but a plurality of communication holes 7 may be provided as long as appropriate strength can be secured in the intermediate portion 47.

Next, with reference to FIGS. 4 to 11, a manufacturing method for a terminal-equipped electric wire 100 as described above (a terminal-equipped electric wire manufacturing method) will be described. The following description will be given based on the flowchart of FIG. 4 and the other drawings will also be referred to as needed.

Figure 5:
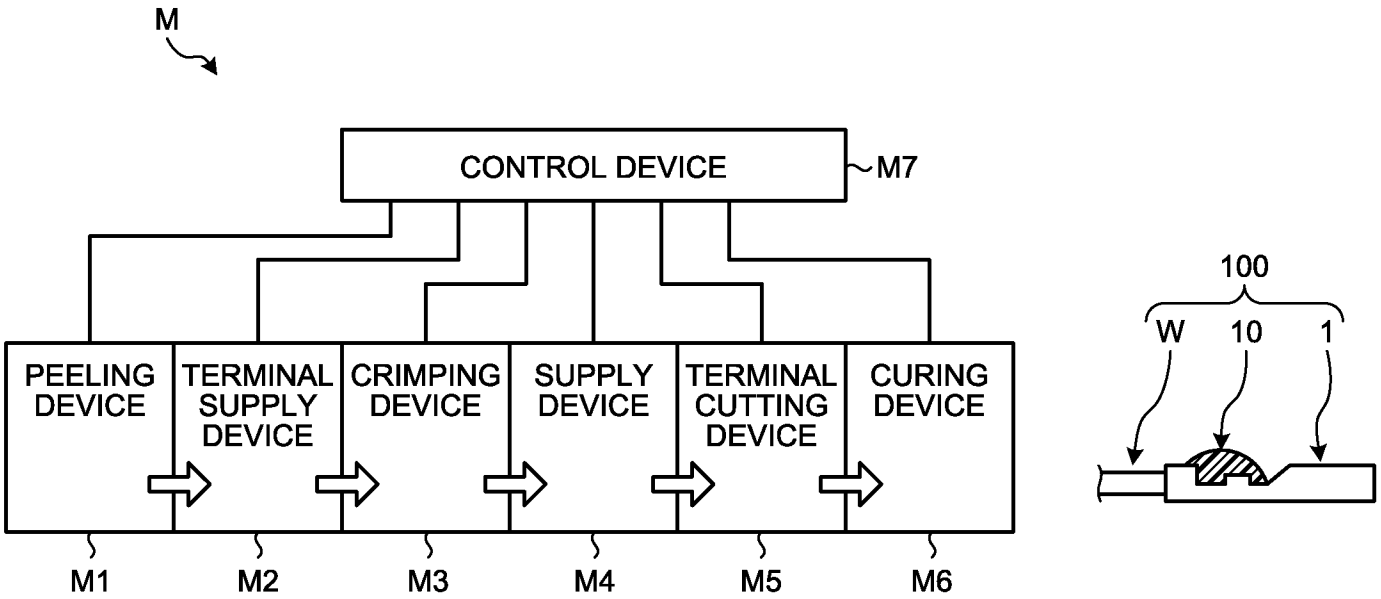
FIG. 5 is a schematic block diagram illustrating a schematic configuration of the terminal-equipped electric wire manufacturing apparatus according to the first embodiment.

The manufacturing method for the terminal-equipped electric wire 100 in this embodiment is automatically performed by a manufacturing apparatus M as a terminal-equipped electric wire manufacturing apparatus illustrated in FIG. 5. The manufacturing apparatus M includes a peeling device M1, a terminal supply device M2, a crimping device M3, a supply device M4, a terminal cutting device M5, a curing device M6, and a control device M7. The terminal supply device M2, the crimping device M3, and the terminal cutting device M5 are formed, for example, in an integral configuration, which may be, therefore, referred to as an applicator in this technical field. Further, the peeling device M1, the supply device M4, the curing device M6, the control device M7, etc., may be configured by their being incorporated in this applicator.

The peeling device M1 is an automatic stripping device that peels the insulative covering portion W2 at one end of the electric wire W and exposes one end of the conductor portion W1 from the end W2*a* (see FIG. 3, etc.) of the insulative covering portion W2. This peeling device M1 performs a peeling step (step ST1).

The terminal supply device M2 is a supply device that pulls out the head of crimp terminals 1 on the outer peripheral side of a terminal chain wound in a reel form and sequentially supplies the crimp terminals 1 to a downstream device (here, the crimping device M3, etc.). Here, the terminal chain is formed by connecting, via carriers or the like, a plurality of crimp terminals 1 before the crimping process, in which the shape of each part is formed by a pressing step or a bending step. The terminal chain is provided in the terminal supply device M2 while kept wound in a reel form.

Figure 6:
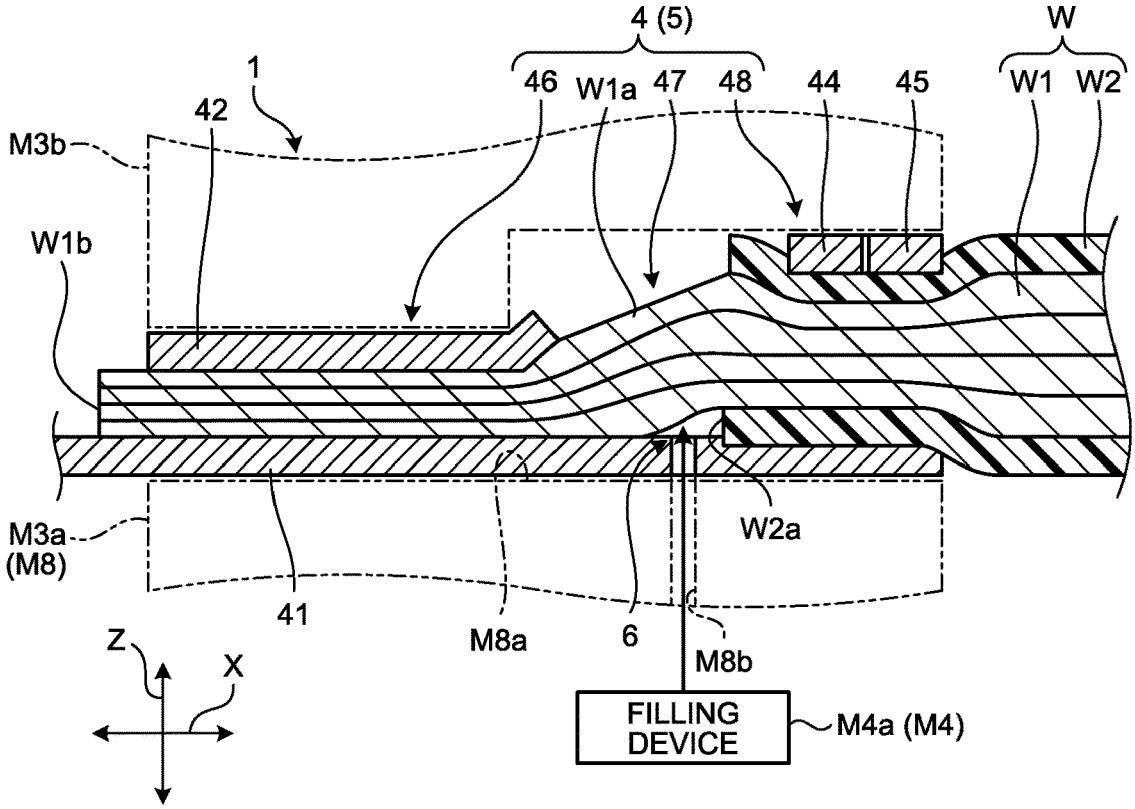
FIG. 6 is a schematic cross-sectional view illustrating the terminal-equipped electric wire and part of the terminal-equipped electric wire manufacturing apparatus, according to the first embodiment.

The crimping device M3 is a device that crimps the crimp terminal 1 to the electric wire W. As illustrated in FIG. 6, using an anvil M3*a* as a lower mold and a crimper M3*b* as an upper mold, the crimping device M3 crimps the conductor crimp portion 46 to the conductor portion W1 and crimps the covering crimp portion 48 to the insulative covering portion W2. The crimping device M3 performs a crimping step (step ST2).

In this case, the anvil M3*a* composes a placing table M8 for placing the crimp terminal 1 onto a placing surface M8*a* on the upper side in the height direction Z. In the anvil M3*a*, the base 41 side of the crimp terminal 1 is placed on the placing surface M8*a*. At a stage before the crimping step (step ST2), the anvil M3*a* functions as a placing table M8 by which the crimp terminal 1 before crimped to the electric wire W is placed onto the placing surface M8*a*. Furthermore, at a stage after the crimping step (step ST2), the anvil M3*a* also functions as a placing table M8 by which the crimp terminal 1 crimped to the electric wire W is placed onto the placing surface M8*a* while kept crimped to the electric wire W.

In the present embodiment, the anvil M3*a* composing the placing table M8 has a distribution hole M8*b*. The distribution hole M8*b* is a hole that forms a passage in which an anticorrosive material (a first anticorrosive material 11*a*, etc.) supplied from the supply device M4, described below, can flow. The distribution hole M8*b* faces the communication hole 7 of the crimp terminal 1 placed on the placing surface M8*a* kept crimped to the electric wire W. The distribution hole M8*b* has an opening at a position facing the communication hole 7 of the crimp terminal 1 at least in the placing surface M8*a* and is formed so as to pass through the anvil M3*a* composing the placing table M8. With this configuration, the manufacturing apparatus M is configured such that, using the distribution hole M8*b* of the placing table M8 and the communication hole 7 of the crimp terminal 1, the first anticorrosive material 11*a* can reliably be supplied from outside of the crimp terminal 1 to the gap space portion 6 where it is difficult to supply the first anticorrosive material 11*a*.

The supply device M4 is a device that supplies the anticorrosive material (the first anticorrosive material 11*a* and the second anticorrosive material 12*a*) to the crimp terminal 1 placed on the placing surface M8*a* of the placing table M8 while kept crimped to the electric wire W. The supply device M4 of the present embodiment includes: a filling device M4*a* (see FIGS. 6 and 7) that pumps the anticorrosive material; and an application device M4*b* (see FIG. 10) that applies the anticorrosive material. The supply device M4 performs the anticorrosive material supply step (step ST3).

Figure 7:
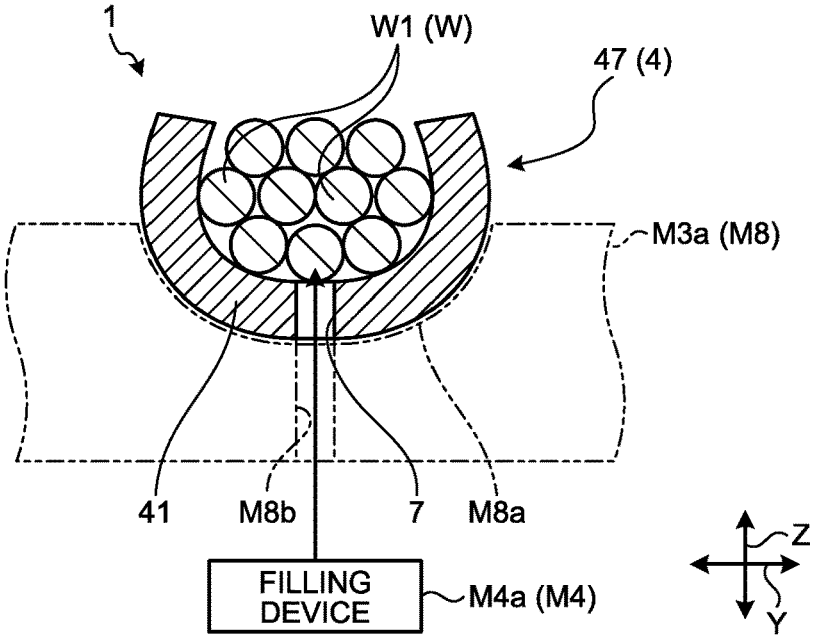
FIG. 7 is a schematic cross-sectional view illustrating the terminal-equipped electric wire and part of the terminal-equipped electric wire manufacturing apparatus, according to the first embodiment.

Specifically, as illustrated in FIG. 6, FIG. 7, etc., the filling device M4*a* is a device that fills the gap space portion 6 with the first anticorrosive material 11*a* through the distribution hole M8*b* and the communication hole 7 while the crimp terminal 1 crimped to the electric wire W is placed on the placing table M8. The filling device M4*a* is connected to one end of the distribution hole M8*b* (the end opposite to the open end on the placing surface M8*a* side), pressurizes the first anticorrosive material 11*a*, and pumps the first anticorrosive material 11*a* into the distribution hole M8*b* and the communication hole 7 such that the anticorrosive material is pushed out. The filling device M4*a* may be connected to one end of the distribution hole M8*b* through, for example, various pipes and hoses.

Figure 10:
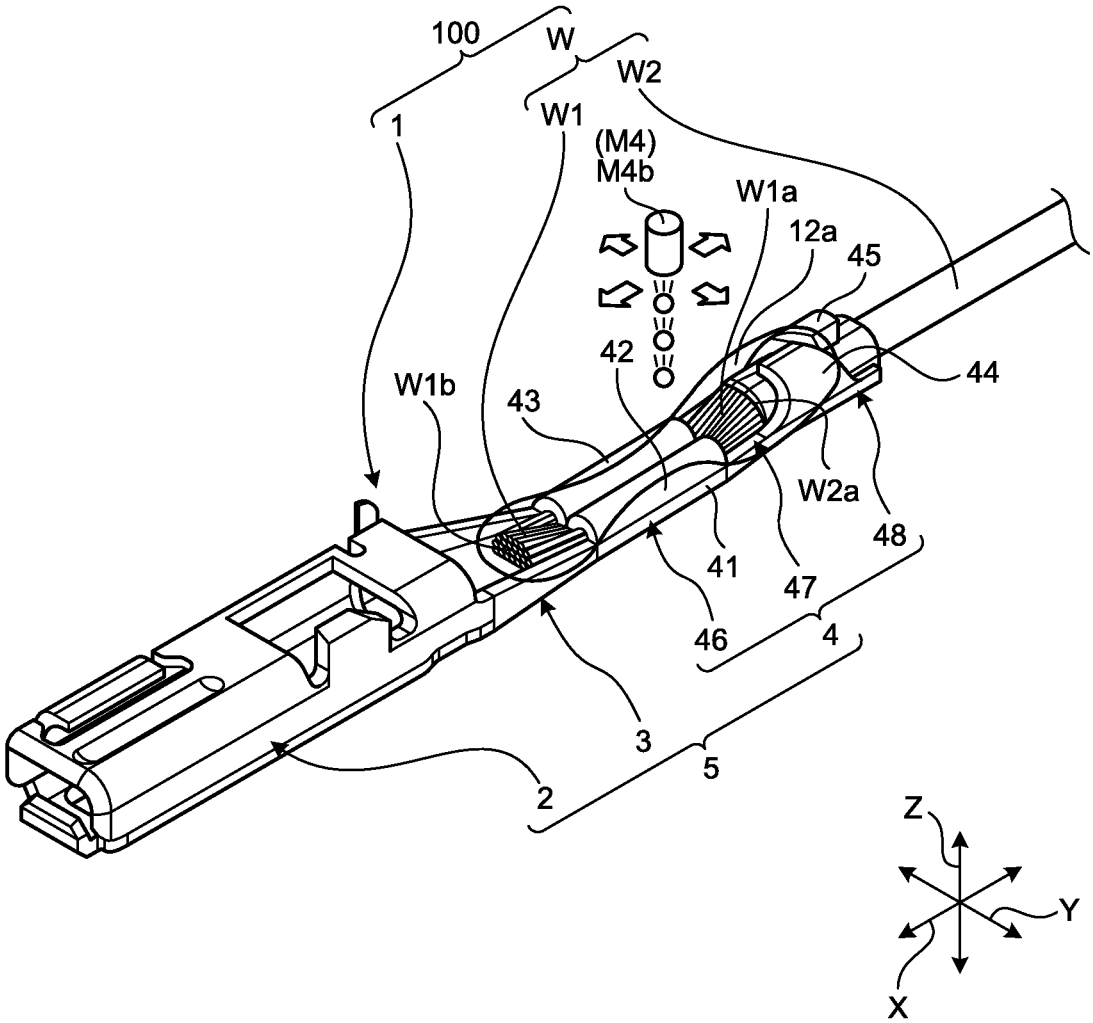
FIG. 10 is a schematic perspective view illustrating the terminal-equipped electric wire and part of the terminal-equipped electric wire manufacturing apparatus, according to the first embodiment.

As illustrated in FIG. 10, etc., the application device M4*b* is a device that applies the second anticorrosive material 12*a* to the crimp terminal 1 while the crimp terminal 1 crimped to the electric wire W is placed on the placing table M8. The application device M4*b* sprays and applies droplets of a predetermined amount of second anticorrosive material 12*a* from a nozzle such as a dispenser toward the crimp terminal 1 by means of, for example, reciprocating movement of a piston. The application device M4*b* can move the nozzle relatively along the axial direction X and the width direction Y. With this configuration, the second anticorrosive material 12*a* can be applied to any position.

The terminal cutting device M5 is a device that separates the crimp terminal 1 after crimping from the terminal chain. This terminal cutting device M5 performs a cutting step (step ST4). The terminal cutting device M5 may perform the disconnection (cutting step) of the crimp terminal 1 from the terminal chain simultaneously with the crimping (crimping step) of the crimp terminal 1 by the crimping device M3.

The curing device M6 is a device that emits light from a light source M6*a* (see FIG. 11, etc.) to the first anticorrosive material 11*a* and the second anticorrosive material 12*a* to cure them. As the light source M6*a*, a UV-LED (Light Emitting Diode) can be used. The UV-LED used as the light source M6*a* is a light-emitting element capable of emitting ultraviolet rays for curing the first anticorrosive material 11*a* and the second anticorrosive material 12*a* that are UV curable resins. This curing device M6 performs a curing step (step ST5).

The control device M7 is a portion that executes various arithmetic processes and controls each part of the manufacturing apparatus M in an integrated manner. The control device M7 includes an electronic circuit mainly including a known microcomputer including a central arithmetic processing apparatus such as a CPU (Central Processing Unit), a ROM (Read Only Memory), a RAM (Random Access Memory), and an interface. The control device M7 controls the peeling device M1, the terminal supply device M2, the crimping device M3, the supply device M4, the terminal cutting device M5, the curing device M6, to cause them to respectively perform the peeling step (step ST1), the crimping step (step ST2), the anticorrosive material supply step (step ST3), the cutting step (step ST4), the curing step (step ST5) and the like. Here, the control device M7 performs a process of, after crimping the crimp terminal 1 to the electric wire W with the crimping device M3, supplying the first anticorrosive material 11*a* and the second anticorrosive material 12*a* to each part of the crimp terminal 1 with the supply device M4. Further, the control device M7 executes a process of simultaneously curing the first anticorrosive material 11*a* and the second anticorrosive material 12*a* with the curing device M6. Now, each step will be described in detail.

First, the control device M7 controls, as the peeling step, the peeling device M1 to perform the peeling process in which the insulative covering portion W2 is peeled off at one end of the electric wire W such that one end of the conductor portion W1 is exposed from one end W2*a* of the insulative covering portion W2 (see FIG. 3, etc.) (step ST1). Then, the control device M7 controls the terminal supply device M2, and performs the subsequent steps while performing a process of pulling out the head of the crimp terminals 1 on the outer peripheral side of the terminal chain and sequentially supplying it to the downstream devices (here, the crimping device M3, etc.).

Next, after the peeling step (step ST1), the control device M7 controls, as a crimping step, the crimping device M3 to perform the crimping process in which the conductor crimp portion 46 of the crimp terminal 1 is crimped to the conductor portion W1 and the covering crimp portion 48 is crimped to the insulative covering portion W2 (step ST2). In the crimping step (step ST2), the crimping device M3 caulks and crimps the crimp terminal 1 to the electric wire W while deforming the electric-wire crimp portion 4 of the crimp terminal 1 using the anvil Mia and crimper M3*b*, as illustrated in FIG. 6.

More specifically, the crimping device M3 places the peeled electric wire W between the two pairs of barrel pieces 42, 43 and 44, 45 while the base 41 of the electric-wire crimp portion 4 is kept placed on the placing surface M8*a* of the anvil M3*a* composing the placing table M8. At this time, the crimping device M3 aligns the distribution hole M8*b* formed in the placing surface M8*a* and the communication hole 7 formed in the base 41, such that they face each other in the height direction Z. The crimping device M3 may be configured such that, for example, the crimp terminal 1 is set so as to fit into a mold formed in the anvil M3*a*, thereby aligning the distribution hole M8*b* and the communication hole 7. Alternatively, the crimping device M3 may be configured such that, for example, the distribution hole M8*b* and the communication hole 7 are aligned by inserting a jig pin or the like into the distribution hole M8*b* and the communication hole 7. Alternatively, the crimping device M3 may be configured such that the distribution hole M8*b* and the communication hole 7 are aligned by, for example, operator's visual observation or the like.

The crimping device M3 places the electric wire W on the base 41 such that a conductor portion W1 is positioned between the barrel pieces 42, 43 of the conductor crimp portion 46, an insulative covering portion W2 is positioned between the barrel pieces 44, 45 of the covering crimp portion 48, and the end W2*a* is positioned between the conductor crimp portion 46 and the covering crimp portion 48. Then, the crimping device M3 presses toward the base 41, gradually inclines inward, and deforms the two pairs of barrel pieces 42, 43, and 44, 45 while bringing the crimper M3*b*, located facing the anvil M3*a* in the height direction Z, relatively close to the anvil M3*a* side in the height direction Z. Consequently, the crimping device M3 wraps and caulks the conductor portion W1 between the base 41 and the pair of barrel pieces 42, 43, in the conductor crimp portion 46 and crimps the pair of barrel pieces 42, 43 to the conductor portion W1. Similarly, the crimping device M3 wraps and caulks the insulative covering portion W2 between the base 41 and the pair of barrel pieces 44, 45, in the covering crimp portion 48 and crimps the pair of barrel pieces 44, 45 to the insulative covering portion W2. As illustrated in FIG. 6, in the crimp terminal 1, the conductor crimp portion 46 and the conductor portion W1 directly contact, adhere, conduct while the conductor crimp portion 46 is kept crimped to the conductor portion W1 and the covering crimp portion 48 is kept crimped to the insulative covering portion W2.

Next, after the crimping step (step ST2), the control device M7 controls, as the anticorrosive material supply step, the supply device M4 to perform the anticorrosive material supply process in which the anticorrosive material (the first anticorrosive material 11*a*, the second anticorrosive material 12*a*) is supplied to a predetermined place of the crimp terminal 1 (step ST3).

In the anticorrosive material supply step (step ST3), the supply device M4 in the present embodiment first supplies the first anticorrosive material 11*a* with the filling device M4*a*, as illustrated in FIGS. 6 and 7. The filling device M4*a* pumps and fills the first anticorrosive material 11*a* toward the gap space portion 6 via the distribution hole M8*b* and the communication hole 7 while the crimp terminal 1 crimped to the electric wire W is kept placed on the placing surface M8*a* of the placing table M8. Consequently, in the crimp terminal 1, the gap space portion 6 and the communication hole 7 are filled with the first anticorrosive material 11*a*.

Figure 8:
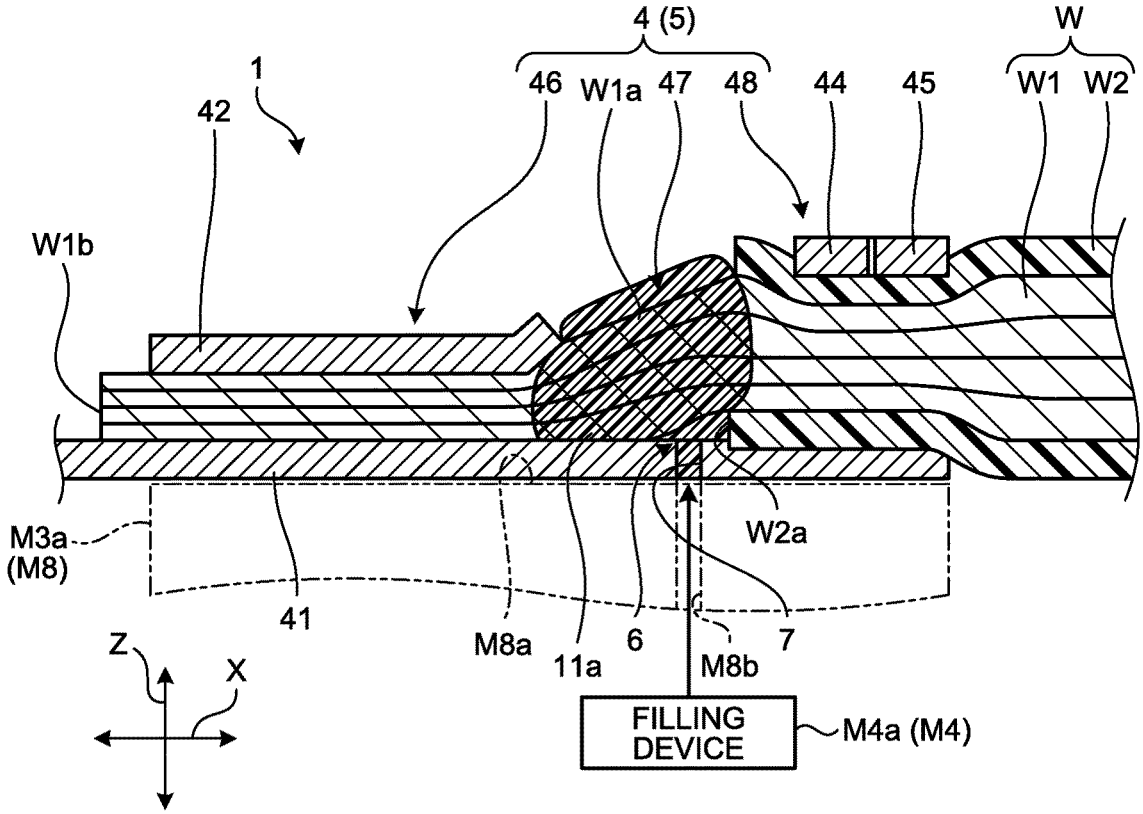
FIG. 8 is a schematic cross-sectional view illustrating the terminal-equipped electric wire and part of the terminal-equipped electric wire manufacturing apparatus, according to the first embodiment.
Figure 9:
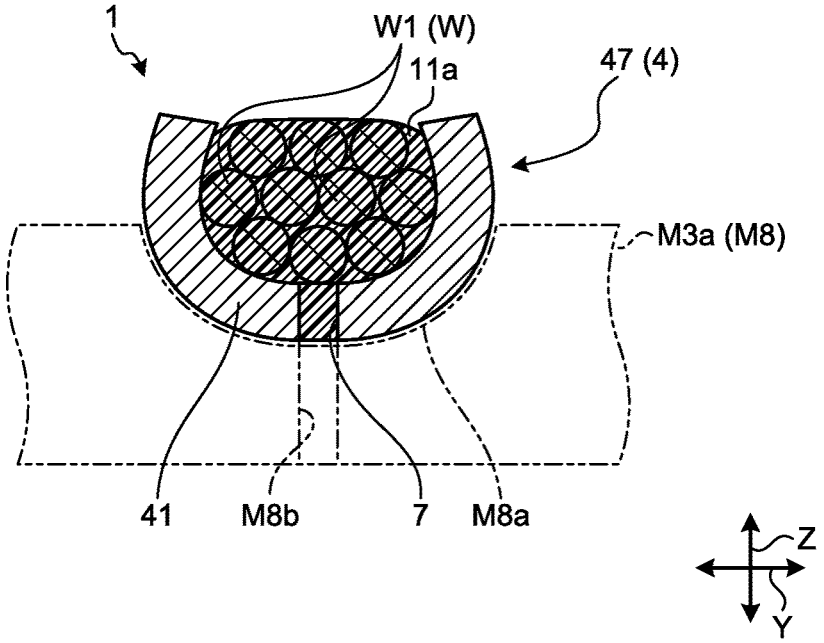
FIG. 9 is a schematic cross-sectional view illustrating a schematic configuration of the terminal-equipped electric wire according to the first embodiment.

In this case, after filling the first anticorrosive material 11*a* into the gap space portion 6, the filling device M4*a* further fills the first anticorrosive material 11*a*, supplied via the distribution hole M8*b* and the communication hole 7, until the anticorrosive material is extruded from between the conductor crimp portion 46 and the covering crimp portion 48 via the gaps between the strands of the conductor portions W1, as illustrated in FIGS. 8 and 9. Thereby, the manufacturing apparatus M can provide the first anticorrosive water-impervious portion 11, formed by curing the first anticorrosive material 11*a*, in the gap space portion 6 and, in addition, provide it so as to cover the intermediate exposed portion Wla of the conductor portion W1 located between the conductor crimp portion 46 and the end W2*a* of the insulative covering portion W2.

In addition, in the anticorrosive material supply step (step ST3), the supply device M4 in the present embodiment also supplies the second anticorrosive material 12*a* with the application device M4*b*, as illustrated in FIG. 10. The application device M4*b* applies the second anticorrosive material 12*a* to the conductor portion W1 exposed from the crimp terminal 1, while the crimp terminal 1 crimped to the electric wire W is kept placed on the placing surface M8*a* of the placing table M8. Here, the application device M4*b* applies the second anticorrosive material 12*a* over the conductor portion W1, exposed from the crimp terminal 1, the conductor crimp portion 46, the insulative covering portion W2, and the so on while moving a nozzle. The portions to which the second anticorrosive material 12*a* is applied also include the position where the first anticorrosive material 11*a* has been extruded from between the conductor crimp portion 46 and the covering crimp portion 48 via the gaps between the strands of the conductor portions W1. That is, in this case, the application device M4*b* applies the second anticorrosive material 12*a* over the leading end W1*b* of the conductor portion W1, exposed from the crimp terminal 1 in the axial direction X, the conductor crimp portion 46, the intermediate exposed portion W1*a*, and the covering crimp portion 48. The second anticorrosive material 12*a* applied to each portion composes a film at each portion and integrally covers these portions. More specifically, the second anticorrosive material 12*a* integrally covers: the leading end W1*b* of the conductor portion W1; part of the conductor crimp portion 46; the first anticorrosive material 11*a* extruded from the intermediate exposed portion W1*a* of the conductor portion W1; the end W2*a* of the insulative covering portion W2; part of the intermediate portion 47; and part of the covering crimp portion 48. Here, the intermediate exposed portion W1*a* of the conductor portion W1 is a portion exposed between the conductor crimp portion 46 and the end W2*a* of the insulative covering portion W2, as described above. The leading end W1*b* of the conductor portion W1 is a portion exposed from the conductor crimp portion 46 toward the electrical connection portion 2 side. Here, it is preferable that the second anticorrosive material 12*a* be applied so as to fill a groove formed by the leading edges, facing each other, of at least the barrel pieces 42, 43. Furthermore, the second anticorrosive material 12*a* penetrates the gaps between the inner strands of the conductor portion W1.

Next, after the anticorrosive material supply step (step ST3), the control device M7 controls, as a cutting step, the terminal cutting device M5 to perform a cutting process in which the crimp terminal 1 crimped to the electric wire W is cut from the terminal chain (Step ST4). In parallel with the crimping step (step ST2) before the anticorrosive material supply step (step ST3), the control device M7 may control, as a cutting step, the terminal cutting device M5 to perform the cutting process in which the crimp terminal 1 crimped to the electric wire W is cut from the terminal chain.

Figure 11:
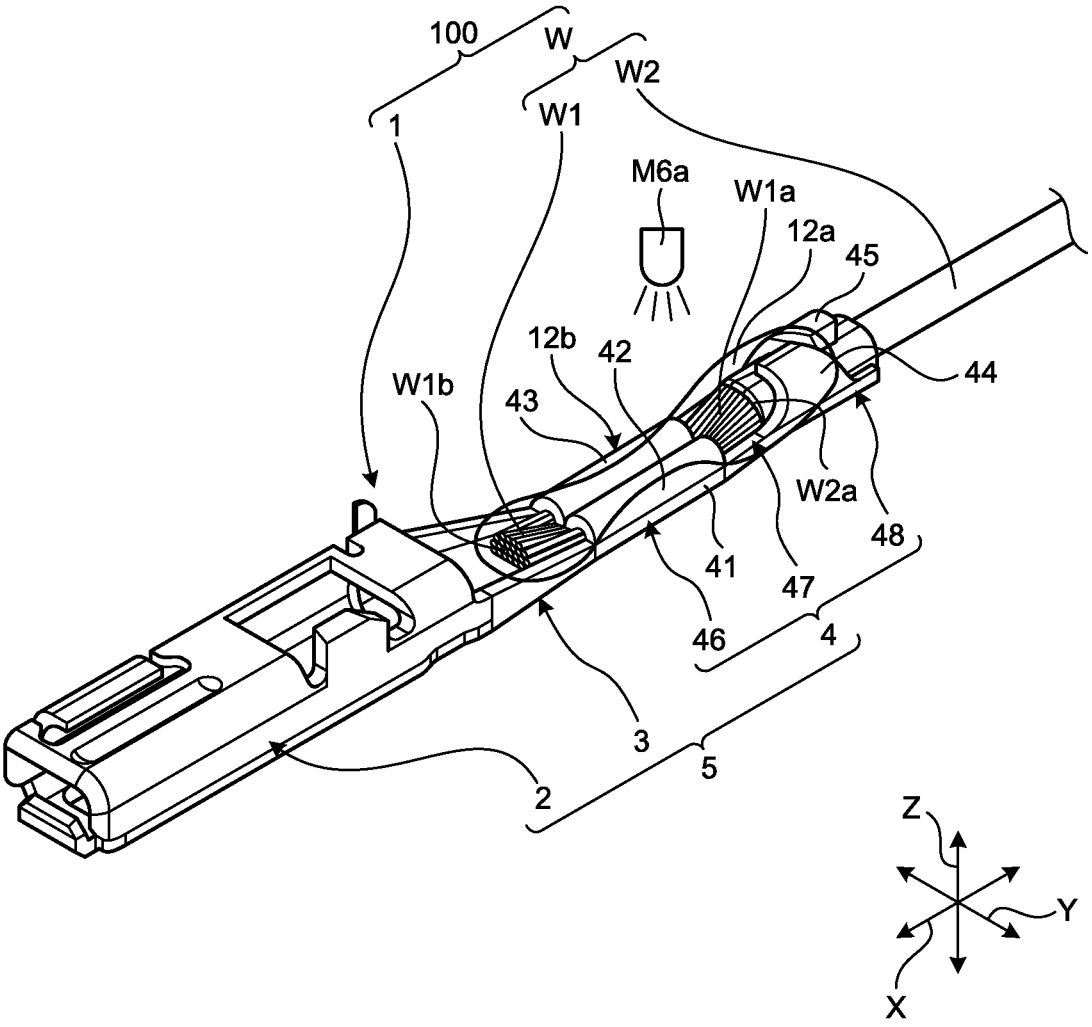
FIG. 11 is a schematic perspective view illustrating the terminal-equipped electric wire and part of the terminal-equipped electric wire manufacturing apparatus, according to the first embodiment.

Next, after the cutting step (step ST4), the control device M7 controls, as a curing step, the curing device M6 to perform a curing process, as illustrated in FIG. 11, in which the first anticorrosive material 11*a* and the second anticorrosive material 12*a* are cured by emitting light thereto (step ST5), and the manufacturing method for the terminal-equipped electric wire 100 is completed. In the curing step (step ST5), the curing device M6 in the present embodiment simultaneously emits light to both the first anticorrosive material 11*a* and the second anticorrosive material 12*a* to cure them. In the curing device M6, for example, as illustrated in FIG. 11, the light source M6*a* is positioned on a side opposite to the side on which the base 41 is located in the height direction Z, and ultraviolet rays are emitted to the first anticorrosive material 11*a* and the second anticorrosive material 12*a* from this light source M6*a*. The ultraviolet rays emitted from the light source M6*a* are irregularly reflected from the surfaces of strands of the conductor portion W1, and reach and cure the first anticorrosive material 11*a* filled in the gap space portion 6 and the first anticorrosive material 11*a* and the second anticorrosive material 12*a* penetrating the inside of the conductor portion W1. The first anticorrosive material 11*a* and the second anticorrosive material 12*a* retain respective shapes by their being cured with ultraviolet rays emitted from the light source M6*a*.

As a result, as illustrated in FIG. 3, gap space portion ultraviolet rays are emitted to the first anticorrosive material 11*a* while the first anticorrosive material 11*a* is filled in the gap space portion 6 and is extruded from the intermediate exposed portion W1*a*. Consequently, the first anticorrosive material 11*a* cures, for example: in the gap space portion 6 inside the crimp terminal 1; inside the intermediate exposed portion W1*a* of the conductor portion Wl; and in a portion between the conductor crimp portion 46 and the covering crimp portion 48, to form the first anticorrosive water-impervious portion 11. By virtue of this, in the terminal-equipped electric wire 100, the first anticorrosive water-impervious portion 11 is able to be securely impervious to water in the gap space portion 6 inside the crimp terminal lterminal-equipped, and in a portion exposed to outside from between the conductor crimp portion 46 and the covering crimp portion 48 in the conductor portion W1. Furthermore, the first anticorrosive material 11*a* has also been filled in the communication hole 7 in addition to the gap space portion 6. Therefore, the first anticorrosive water-impervious portion 11 is filled in the communication hole 7 as well, thus making it possible to securely block entry of water into the communication hole 7.

Meanwhile, as illustrated in FIGS. 1 and 3, ultraviolet rays are emitted to the second anticorrosive material 12*a* integrally covering: the conductor portion W1 exposed from the crimp terminal 1; the conductor crimp portion 46; the first anticorrosive material 11*a* exposed from between the conductor crimp portion 46 and the covering crimp portion 48; and the insulative covering portion W2. Consequently, this anticorrosive material 12*a* cures outside the crimp terminal 1 to form the second anticorrosive water-impervious portion 12. By virtue of this, the second anticorrosive water-impervious portion 12 covers, in the terminal-equipped electric wire 100, the leading end W1*b* of the conductor portion W1; part of the conductor crimp portion 46; the first anticorrosive material 11*a* (the first anticorrosive water-impervious portion 11) of the intermediate exposed portion W1*a* of the conductor portion W1; the end W2*a* of the insulative covering portion W2; part of the intermediate portion 47; and part of the covering crimp portion 48, thus making it possible to make them securely impervious to water integrally. In other words, the second anticorrosive water-impervious portion 12 can block off the exposed portion of the conductor portion W1 from outside space and make the exposed portion securely impervious to water.

The manufacturing apparatus M and the terminal-equipped electric wire 100 described above enable the first anticorrosive material 11*a* to be supplied to the gap space portion 6 via the communication hole 7 formed in the crimp terminal 1 and via the distribution hole M8*b* formed in the placing table M8. The gap space portion 6 is a space portion surrounded by the crimp terminal 1, the conductor portion W1, and the end W2*a* of the insulative covering portion W2. Thus, the manufacturing apparatus M and the terminal-equipped electric wire 100 enable the first anticorrosive material 11*a* to securely be supplied to the gap space portion 6 where it is difficult to supply the first anticorrosive material 11*a* from outside, thus making it possible to securely block entry of water into the gap space portion 6. As a result, the manufacturing apparatus M and the terminal-equipped electric wire 100 enable the first anticorrosive material 11*a* to securely form the first anticorrosive water-impervious portion 11, for example, in the gap space portion 6 inside the crimp terminal 1 where it is difficult to apply the first anticorrosive material 11*a* after the crimping of the crimp terminal 1; and the inside of the portion located between the conductor crimp portion 46 and the covering crimp portion 48 in the conductor portion W1, making it possible to securely block entry of water. Furthermore, in the terminal-equipped electric wire 100 of the present embodiment, the first anticorrosive material 11*a* has also been filled in the communication hole 7 in addition to the gap space portion 6, and the first anticorrosive water-impervious portion 11 can be formed in the communication hole 7 as well by the first anticorrosive material 11*a*, thus making it possible to securely block entry of water.

Furthermore, in this case, as described above, the manufacturing apparatus M and the terminal-equipped electric wire 100 enable the first anticorrosive material 11*a* to be supplied to the inside of the crimp terminal 1, including the gap space portion 6, from the supply device M4 by making use of the communication hole 7 and the distribution hole M8*b*. As a result, the manufacturing apparatus M and the terminal-equipped electric wire 100 can shorten a time required for the first anticorrosive material 11*a* to penetrate the inside of the conductor portion W1, in comparison with, for example, a case where the first anticorrosive material 11*a* is applied to the portion between the conductor crimp portion 46 and the covering crimp portion 48 of the conductor portion W1 from outside and allowed to naturally penetrate the inside. As a result, the manufacturing apparatus M and the terminal-equipped electric wire 100 can restrict, for example, a cycle time related to the manufacture of the terminal-equipped electric wire 100 and restrict the manufacturing cost.

In addition, since the manufacturing apparatus M and the terminal-equipped electric wire 100 enables the first anticorrosive material 11*a* to be supplied to the gap space portion 6 after the crimping of the crimp terminal 1 to the electric wire W, it possible to securely prevent the first anticorrosive material 11*a* from intervening in the adhesion portion between the conductor crimp portion 46 formed by crimping and the conductor portion W1. As a result, while crimped to the electric wire W, the crimp terminal 1 can conduct the conductor crimp portion 46 and the conductor portion W1 in direct contact with each other without the first anticorrosive material 11*a* intervening in a portion where the conductor crimp portion 46 and the conductor portion W1 conduct in contact with each other. As a result, the crimp terminal 1 can reliably ensure appropriate conduction performance as well. As a result, the manufacturing apparatus M and the terminal-equipped electric wire 100 can not only guarantee an appropriate water-impervious anticorrosive performance but also ensure an appropriate conduction performance, in the terminal-equipped electric wire 100.

As described above, the manufacturing apparatus M and the terminal-equipped electric wire 100 make a portion including the gap space portion 6 and the entire periphery of the conductor portion W1 inside the crimp terminal 1 securely impervious to water, making it possible to securely restrict entry of water and so on into a space between the conductor portion W1 and the crimp terminal 1 and toward the conductor portion W1. As a result, the manufacturing apparatus M and the terminal-equipped electric wire 100 enable manufacture of the terminal-equipped electric wire 100 that ensures appropriate water-impervious performance and enable appropriate anticorrosion performance to be secured in this terminal-equipped electric wire 100. For example, in the terminal-equipped electric wire 100, if the material of the conductor portion W1 is aluminum and the material of the crimp terminal 1 is copper and if water enters between the two, the conductor portion W1 may corrode (galvanic corrosion) due to the difference in ionization tendency. Compared to this, the terminal-equipped electric wire 100 can hinder the occurrence of the corrosion by restricting entry of water as described above.

Here, the manufacturing apparatus M and the terminal-equipped electric wire 100 described above can quickly and securely fill the gap space portion 6 with the first anticorrosive material 11*a* via the distribution hole M8*b* and the communication hole 7 by the filling device M4*a* composing the supply device M4. Also, with this configuration, the manufacturing apparatus M and the terminal-equipped electric wire 100 can cause the first anticorrosive material 11*a* to quickly and securely penetrate not only the gap space portion 6 but also the gaps between the strands of the conductor portion W1 and the surface of the intermediate exposed portion Wla. As a result, by making use of the first anticorrosive material 11*a*, the manufacturing apparatus M and the terminal-equipped electric wire 100 can securely block entry of water not only into the gap space portion 6 but also into a portion exposed to outside from between the conductor crimp portion 46 and the covering crimp portion 48 in the conductor portion W1 of the electric wire W. In other words, by making use of the first anticorrosive material 11*a* filled from the filling device M4*a* via the distribution hole M8*b* and the communication hole 7 into the crimp terminal 1 after crimping, the manufacturing apparatus M and the terminal-equipped electric wire 100 forms the first anticorrosive water-impervious portion 11 in the gap space portion 6 and in the portion exposed to outside from between the conductor crimp portion 46 and the covering crimp portion 48 in the conductor portion W1, making it possible to securely block entry of water. In addition, using the filling device M4*a*, the manufacturing apparatus M and the terminal-equipped electric wire 100 fill the first anticorrosive material 11*a* into the crimp terminal 1, thus making it possible to hinder mixture of bubbles into the filled first anticorrosive material 11*a* and hence the first anticorrosive water-impervious portion 11. As a result, the manufacturing apparatus M and the terminal-equipped electric wire 100 enable manufacture the terminal-equipped electric wire 100 that ensures more appropriate water-impervious performance.

In addition, in the manufacturing apparatus M and the terminal-equipped electric wire 100 described above, the placing table M8 in which the distribution hole M8*b* is formed is composed of the anvil Mia that crimps the crimp terminal 1 to the electric wire W. This configuration makes it possible for the manufacturing apparatus M and the terminal-equipped electric wire 100 to proceed, subsequent to the step of crimping the crimp terminal 1 to the electric wire W, to the step of supplying the first anticorrosive material 11*a* from the supply device M4 via the distribution hole M8*b* and the communication hole 7 to the portion including the gap space portion 6. Also in this respect, the manufacturing apparatus M and the terminal-equipped electric wire 100 can restrict, for example, the cycle time related to the manufacture of the terminal-equipped electric wire 100 and restrict the manufacturing cost.

Furthermore, in the manufacturing apparatus M and the terminal-equipped electric wire 100 described above, the second anticorrosive material 12*a* is applied over the conductor portion W1 exposed from the crimp terminal 1, the conductor crimp portion 46, the first anticorrosive material 11*a* exposed from between the conductor crimp portion 46 and the covering crimp portion 48, and the insulative covering portion W2, such that these are covered with this second anticorrosive material 12*a*. As a result, by making use of the second anticorrosive material 12*a* applied to the crimp terminal 1, the manufacturing apparatus M and the terminal-equipped electric wire 100 can more securely block entry of water into each of the portions. As a result, the manufacturing apparatus M and the terminal-equipped electric wire 100 make the periphery of the conductor portion W1 securely impervious to water, and more securely restrict entry of water and so on into the space between the conductor portion W1 and the crimp terminal 1 and toward this conductor portion W1, thus making it possible to manufacture the terminal-equipped electric wire 100 that ensures more appropriate water-impervious performance.

Second Embodiment

A terminal-equipped electric wire manufacturing apparatus and a terminal-equipped electric wire according to the second embodiment differ from those in the first embodiment in the configuration of the supply device. In the following, the same components as those in the embodiment described above are labeled with the same reference symbols and duplication of description of the common configurations, operations, and effects is omitted as much as possible.

Figure 12:
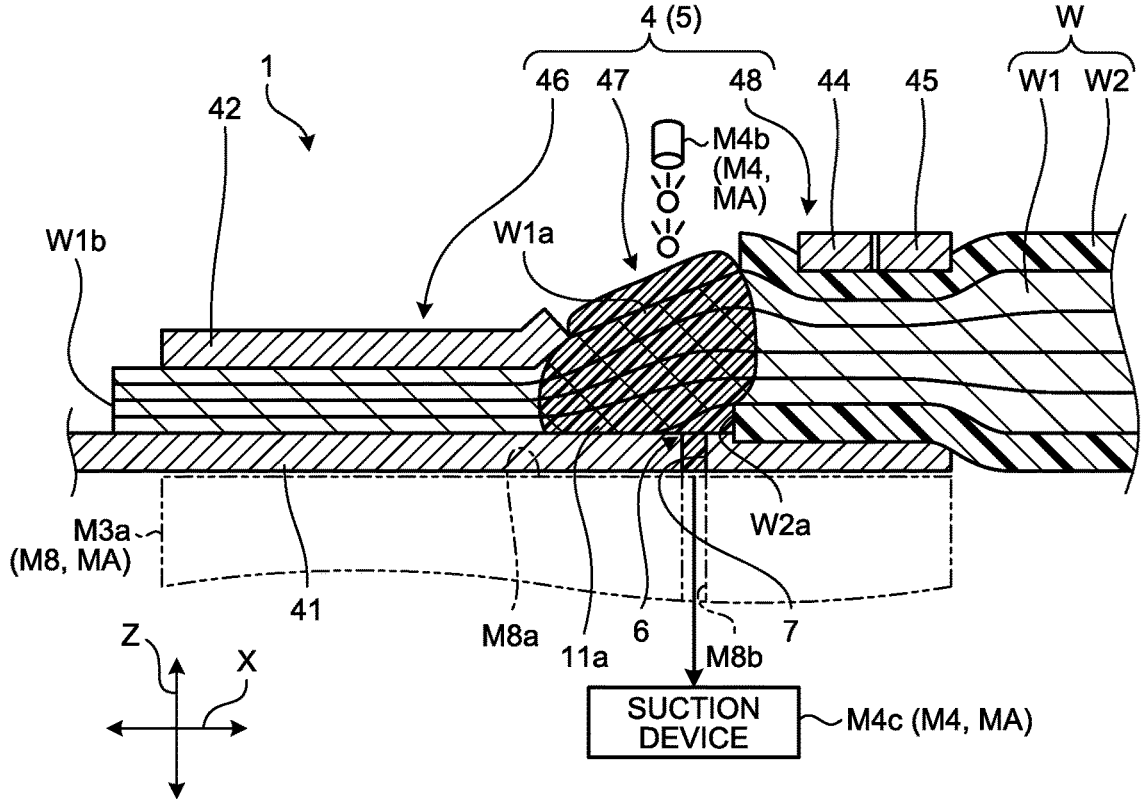
FIG. 12 is a schematic cross-sectional view illustrating a terminal-equipped electric wire and part of a terminal-equipped electric wire manufacturing apparatus, according to a second embodiment.
Figure 13:
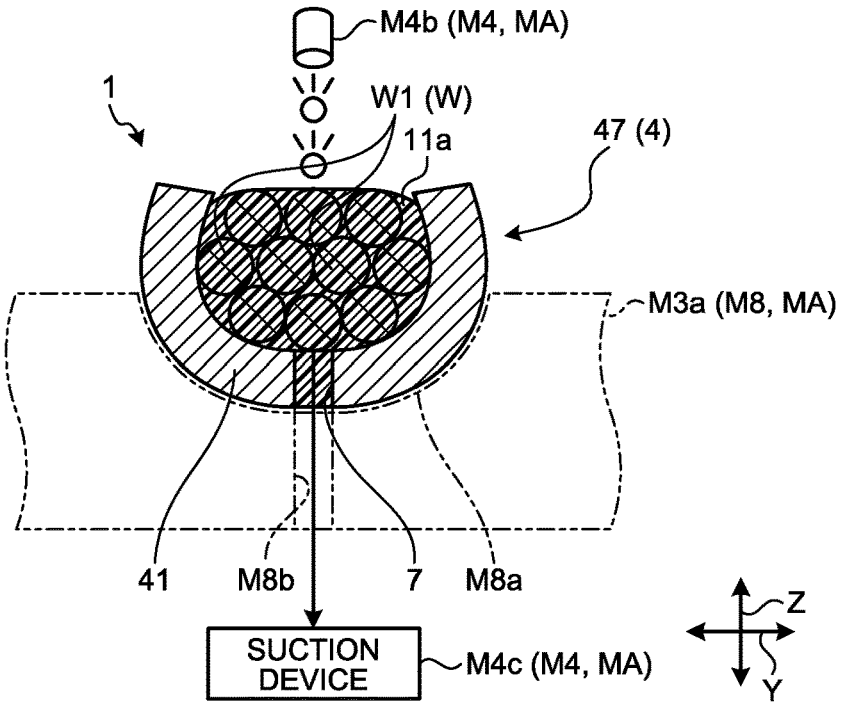
FIG. 13 is a schematic cross-sectional view illustrating the terminal-equipped electric wire and part of the terminal-equipped electric wire manufacturing apparatus, according to the second embodiment.

A manufacturing apparatus MA as the terminal-equipped electric wire manufacturing apparatus according to the present embodiment illustrated in FIGS. 12 and 13 differs from the above-described manufacturing apparatus M in the configuration of the supply device M4. The other configurations of the manufacturing apparatus MA are substantially the same as those of the manufacturing apparatus M described above.

The supply device M4 of the present embodiment includes a suction device M4*c* instead of the filling device M4*a*. In addition, an application device M4*b* of the present embodiment is also used as a device for applying, in addition to a second anticorrosive material 12*a*, a first anticorrosive material 11*a* to a crimp terminal 1.

The application device M4*b* of the present embodiment also supplies the first anticorrosive material 11*a* in an anticorrosive material supply step (step ST3). While the crimp terminal 1 crimped to an electric wire W placed on a placing surface M8*a* of a placing table M8, the application device M4*b* applies the first anticorrosive material 11*a* to an intermediate exposed portion W1*a* of a conductor portion W1 exposed between a covering crimp portion 48 and a conductor crimp portion 46. As described above, the application device M4*b* can move the nozzle relatively along an axial direction X and a width direction Y. With this configuration, the first anticorrosive material 11*a* can be applied to the intermediate exposed portion W1*a*.

Then, the suction device M4*c* of the present embodiment is a device that, while the crimp terminal 1 crimped to the electric wire W is placed on the placing table M8, sucks via a gap space portion 6, a communication hole 7, and a distribution hole M8*b* the first anticorrosive material 11*a* applied to the conductor portion W1 by the application device M4*b*. The suction device M4*c* is connected to one end of the distribution hole M8*b* (the end opposite the open end on the placing surface M8*a* side) and generates a negative pressure via the distribution hole M8*b*, thereby sucking out the first anticorrosive material 11*a* via the gap space portion 6, the communication hole 7, and the distribution hole M8*b*. The suction device M4*c* may be connected to the one end of the distribution hole M8*b* via various pipes or hoses, for example.

In the anticorrosive material supply step (step ST3), using the application device M4*b*, the supply device M4 of the present embodiment first supplies the first anticorrosive material 11*a*. As described above, while the crimp terminal 1 crimped to the electric wire W is placed on the placing surface M8*a* of the placing table M8, the application device M4*b* applies the first anticorrosive material 11*a* to the intermediate exposed portion W1*a* from the side opposite the anvil Mia composing the placing table M8. Then, using the suction device M4*c*, the supply device M4 sucks, via the gap space portion 6, communication hole 7, and distribution hole M8*b* on the anvil Mia side, the first anticorrosive material 11*a* applied to the intermediate exposed portion W1*a*. Thereby, the suction device M4*c* can force the first anticorrosive material 11*a* applied to the intermediate exposed portion W1*a* to penetrate the inside of the crimp terminal 1, including the gap space portion 6, via the gaps between the strands of the conductor portion W1. Thus, in crimp terminal 1, the first anticorrosive material 11*a* has been filled into: the gaps between the strands of the intermediate exposed portion W1*a* between the conductor crimp portion 46 and the covering crimp portion 48; the gap space portion 6; and the communication hole 7. As a result, the manufacturing apparatus MA makes it possible for a first anticorrosive water-impervious portion 11 formed by curing the first anticorrosive material 11*a* to be provided in: gaps between the strands of the intermediate exposed portion W1*a*; the gap space portion 6; and the communication hole 7.

The manufacturing apparatus MA and the terminal-equipped electric wire 100 described above make a portion including the gap space portion 6 and the entire periphery of the conductor portion W1 inside the crimp terminal 1 securely impervious to water, making it possible to securely restrict entry of water and so on into a space between the conductor portion W1 and the crimp terminal 1 and toward the conductor portion W1. As a result, the manufacturing apparatus MA and the terminal-equipped electric wire 100 enable the manufacture of the terminal-equipped electric wire 100 that ensures appropriate water-impervious performance.

The manufacturing apparatus MA and the terminal-equipped electric wire 100 described above enable the first anticorrosive material 11*a* to be applied to the intermediate exposed portion W1*a* of the conductor portion W1 by the application device M4*b* composing the supply device M4. Also, the manufacturing apparatus MA and the terminal-equipped electric wire 100 enable the first anticorrosive material 11*a* applied to the intermediate exposed portion W1*a* of the conductor portion W1 to be sucked via the gap space portion 6, the communication hole 7, and the distribution hole M8*b* by the suction device M4*c* composing the supply device M4. With this configuration, the manufacturing apparatus M and the terminal-equipped electric wire 100 enable the first anticorrosive material 11*a* applied to the intermediate exposed portion W1*a* to quickly and securely penetrate the inside of the crimp terminal 1, including the gap space portion 6, via the gaps between the strands of the conductor portion W1. In addition, with this configuration, the manufacturing apparatus MA and the terminal-equipped electric wire 100 enable the first anticorrosive material 11*a* to quickly and securely penetrate not only the gap space portion 6 but also the gaps between the strands of the conductor portion W1 and the surface of the intermediate exposed portion W1*a*. As a result, by making use of the first anticorrosive material 11*a*, the manufacturing apparatus MA and the terminal-equipped electric wire 100 can securely block entry of water not only into the gap space portion 6 but also into a portion exposed to outside from between the conductor crimp portion 46 and the covering crimp portion 48 in the conductor portion W1 of the electric wire W. In other words, by making use of the first anticorrosive material 11*a* sucked into the crimp terminal 1 by the suction device M4*c* via the gap space portion 6, the communication hole 7, and the distribution hole M8*b*, the manufacturing apparatus MA and the terminal-equipped electric wire 100 securely form the first anticorrosive water-impervious portion 11 in the portion exposed to outside from between the conductor crimp portion 46 and the covering crimp portion 48 in the conductor portion W1; and in the crimp terminal 1 including the gap space portion 6, making it possible to block entry of water. In addition, using the suction device M4*c*, the manufacturing apparatus MA and the terminal-equipped electric wire 100 suck the first anticorrosive material 11*a* into the crimp terminal 1, thus making it possible to hinder mixture of bubbles into the sucked first anticorrosive material 11*a* and hence the first anticorrosive water-impervious portion 11 formed by the first anticorrosive material 11*a*. As a result, the manufacturing apparatus MA and the terminal-equipped electric wire 100 enable manufacture the terminal-equipped electric wire 100 that ensures more appropriate water-impervious performance.

In addition, the terminal-equipped electric wire manufacturing apparatus and the terminal-equipped electric wire according to the foregoing embodiments of the present invention are not limited by the foregoing embodiments and various changes can be made to them within the scopes of the claims.

The above description says that the placing table M8 is composed of the anvil M3*a*, but it is not limited thereto. Separately from the anvil M3*a* or the like, the placing table M8 may be provided exclusively.

The above description says that the application device M4*b* is also used as a device that applies, in addition to the second anticorrosive material 12*a*, the first anticorrosive material 11*a* to the crimp terminal 1, but it is not limited thereto. The application device for applying the first anticorrosive material 11*a* and the application device for applying the second anticorrosive material 12*a* may be provided separately.

In the above description, typically, the same UV curable resin can be used as the first anticorrosive material 11*a* and the second anticorrosive material 12*a*. However, depending on, for example, a situation in which each is applied, they may be different. For example, they may differ in viscosity or the like.

The above description says that the first anticorrosive material 11*a* and the second anticorrosive material 12*a* are both assumed to be UV curable resins, but they not limited thereto. The first anticorrosive material 11*a* and the second anticorrosive material 12*a* may be, for example, thermosetting resins that are cured by the application of heat.

The terminal-equipped electric wire manufacturing apparatus and the terminal-equipped electric wire according to the present embodiments may be suitably combined with the components of the embodiments and modified embodiments described above.

The terminal-equipped electric wire manufacturing apparatus and the terminal-equipped electric wire according to the present embodiment enables the supply of the anticorrosive material to the gap space portion via the communication hole formed in the crimp terminal and the distribution hole formed in the placing table. The gap space portion is a space portion surrounded by the crimp terminal, the conductor portion, and the end of the insulative covering portion. Thereby, the terminal-equipped electric wire manufacturing apparatus and the terminal-equipped electric wire enable the anticorrosive material to be securely supplied to the gap space portion where it is difficult to supply the anticorrosive material from outside, thus making it possible to securely block entry of water into this gap space portion. As a result, the terminal-equipped electric wire manufacturing apparatus and the terminal-equipped electric wire yield the effect in that a terminal-equipped electric wire that secures appropriate water-impervious performance can be manufactured.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A terminal-equipped electric wire manufacturing apparatus, comprising:

a placing table on which a crimp terminal is placed while kept crimped to an electric wire, the crimp terminal including an electric wire crimp portion having a base serving as a bottom wall on which the electric wire is placed, the electric wire crimp portion including a covering crimp portion crimped to an insulative covering portion of the electric wire in which a conductor portion having conductivity is covered with the insulative covering portion having insulating properties, and a conductor crimp portion crimped to the conductor portion exposed from an end of the insulative covering portion; and a supply device that supplies an anticorrosive material to the crimp terminal placed on the placing table while kept crimped to the electric wire, wherein while kept crimped to the electric wire, the crimp terminal has a communication hole, which is formed in the base of the electric wire crimp portion, allowing communication between a gap space portion and outside of the crimp terminal, the gap space portion being surrounded by the base of the electric wire crimp portion, the conductor portion, and the end of the insulative covering portion, and the placing table has a distribution hole positioned opposite the communication hole of the crimp terminal placed while kept crimped to the electric wire, the distribution hole allowing the anticorrosive material, supplied from the supply device, to flow in the distribution hole.

2. The terminal-equipped electric wire manufacturing apparatus according to claim 1, wherein the supply device includes a filling device that fills the anticorrosive material into the gap space portion via the distribution hole and the communication hole while the crimp terminal crimped to the electric wire is kept placed on the placing table.

3. The terminal-equipped electric wire manufacturing apparatus according to claim 2, wherein the filling device is able to fill the anticorrosive material until the anticorrosive material supplied via the distribution hole and the communication hole extrude from between the conductor crimp portion and the covering crimp portion via the conductor portion.

4. The terminal-equipped electric wire manufacturing apparatus according to claim 3, wherein the placing table is composed of an anvil that crimps the crimp terminal to the electric wire.

5. The terminal-equipped electric wire manufacturing apparatus according to claim 2, wherein the placing table is composed of an anvil that crimps the crimp terminal to the electric wire.

6. The terminal-equipped electric wire manufacturing apparatus according to claim 1, wherein the supply device includes an application device that, while the crimp terminal crimped to the electric wire is placed on the placing table, applies the anticorrosive material to the conductor portion exposed between the covering crimp portion and the conductor crimp portion, and a suction device that sucks, via the gap space portion, the communication hole, and the distribution hole, the anticorrosive material applied to the conductor portion by the application device.

7. The terminal-equipped electric wire manufacturing apparatus according to claim 6, wherein the placing table is composed of an anvil that crimps the crimp terminal to the electric wire.

8. The terminal-equipped electric wire manufacturing apparatus according to claim 1, wherein the placing table is composed of an anvil that crimps the crimp terminal to the electric wire.

9. A terminal-equipped electric wire, comprising:

an electric wire in which a conductor portion having conductivity is covered with an insulative covering portion having insulating properties;

a crimp terminal including an electric wire crimp portion having a base serving as a bottom wall on which the electric wire is placed, the electric wire crimp portion including a covering crimp portion crimped to the insulative covering portion, and a conductor crimp portion crimped to the conductor portion exposed from an end of the insulative covering portion; and an anticorrosive material applied to the crimp terminal, wherein while kept crimped to the electric wire, the crimp terminal has a communication hole, which is formed in the base of the electric wire crimp portion, allowing communication between a gap space portion and outside of the crimp terminal, the gap space portion being surrounded by the base of the electric wire crimp portion, the conductor portion, and the end of the insulative covering portion, and the gap space portion and the communication hole are filled with the anticorrosive material.

* * * * *